United States Patent [19]

Cummings et al.

[11] 4,441,256

[45] Apr. 10, 1984

[54] MANIPULATOR FOR CREATING A MULTIPLICITY OF VARIED LINE DESIGNS

[75] Inventors: Charles A. Cummings; William R. La Dow, both of Cincinnati, Ohio

[73] Assignee: CPG Products Corp., Minneapolis, Minn.

[21] Appl. No.: 444,262

[22] Filed: Nov. 23, 1982

[51] Int. Cl.[3] ..... B43L 11/00

[52] U.S. Cl. ..... 33/27 L

[58] Field of Search ..... 33/27 L, 23, 24, 25

[56] References Cited

U.S. PATENT DOCUMENTS

| | | | |
|---|---|---|---|
| 1,071,681 | 9/1913 | Allen | 33/27 L |
| 2,300,698 | 11/1942 | Pentz | 33/18 B |
| 3,230,624 | 1/1966 | Fisher | 33/27 L |
| 3,929,462 | 12/1975 | Karmin | 33/25 B X |

FOREIGN PATENT DOCUMENTS

| | | | |
|---|---|---|---|
| 491365 | 3/1954 | Italy | 33/23 F |

*Primary Examiner*—Harry N. Haroian

*Attorney, Agent, or Firm*—Gene O. Enockson; L. MeRoy Lillehaugen; Stuart R. Peterson

[57] ABSTRACT

The manipulator includes an internally toothed ring, an externally toothed wheel, and a cam arm. The wheel and arm, which function in a "master" capacity, have registerable holes for accommodating the tip of a ballpoint pen so that a primary line design is created as the ballpoint pen is manually moved over a sheet of paper while maintaining the wheel teeth in mesh with the ring teeth. The ring has at least one pivot post projecting upwardly into a slot in the cam arm to cause the cam arm to function in a "slave" capacity so that a fiber-tipped pen gripped by the cam arm produces a secondary line design at the same time the primary line design is being produced.

15 Claims, 10 Drawing Figures

MANIPULATOR FOR CREATING A MULTIPLICITY OF VARIED LINE DESIGNS

BACKGROUND OF THE INVENTION

1. Field of the Invention

This invention relates generally to apparatus for producing line designs of an epicyclic nature, and pertains more particularly to a manipulator for simultaneously producing two such designs that are visually distinct from each other.

2. Description of the Prior Art

Apparatus for producing single line designs is disclosed in U.S. Reissue Pat. No. 26,341, reissued to Denys Fisher on Feb. 6, 1968 for "INSTRUMENTS OR APPARATUS", the original patent being U.S. Pat. No. 3,230,624, granted on Jan. 5, 1966. The alluded to patent discloses and claims a primary ring member having externally and internally disposed gear teeth and a secondary wheel or disk member having externally disposed teeth that in use are continually in mesh with either the external or internal teeth on the primary ring member. The secondary member has a series of small holes formed therein so that a ballpoint pen, when its tip is inserted in a selected hole, will guide the ballpoint pen in the making of various epicyclic-type designs. The apparatus disclosed in the reissue patent progressively forms only a single design which is confined to but one area on the paper or other marking surface.

SUMMARY OF THE INVENTION

An object of the present invention is to provide a manipulator capable of simultaneously making two separate and distinct line designs. In this regard, use is made of the patented apparatus, the patented apparatus functioning as a master apparatus or device to create a primary design, our manipulator further including a cam arm that functions as a slave apparatus or device controlled by the master apparatus to create a secondary design concomitantly with the production of the primary design. Therefore, an important aim of our invention is to add excitement and intrigue to the more basic apparatus disclosed in said reissue patent.

Another object of the invention is to permit the use of the more basic apparatus described in said reissue patent either with or without the cam arm that enables the user to produce a unique second design. Thus, if the person wishes to make only one design, he or she can do so by using only the more basic apparatus, yet that person is provided with the choice of simultaneously creating two distinctly different and spatially separated designs if he or she wishes.

A further object is to provide a manipulator, which is capable of creating or generating two distinct designs, that can be manufactured at only a slight additional cost over and above the cost of manufacturing the more basic apparatus described in said reissue patent.

Consequently, a general object of our invention is to provide a manipulator that possesses a greater appeal than the prior art apparatus by reason of the multiplicity of line designs that can be created, the increase in the number of designs being compounded by virtue of only one additional member, coupled with a slight modification of the ring member utilized in the prior art apparatus.

Briefly, our invention envisages the use of a ring member having internally disposed teeth and a wheel member having externally disposed teeth, the wheel member having a number of holes formed therein. The ring member has several upstanding pivot posts. A cam arm having a downwardly facing slot overlies any one of the several pivot posts, the cam arm having a hole at one end thereof which is registerable with a selected hole in the wheel member. A marking implement in the form of a ballpoint pen, when received in the hole formed in the cam arm and one of the holes in the wheel member, will cause the cam arm to pivot or oscillate, as well as move longitudinally, relative to the ring member. Resilient means at the other end of the cam arm releasably grips a second marking implement in the form of a fiber-tipped pen, to create a second design while the first marking element is producing a primary design. Wings extend laterally from opposite sides of the cam arm, the wings having rounded feed depending from their undersides to stabilize the cam arm while making the secondary design. Stated somewhat differently, the ring and wheel members function as a master means for producing the primary design, whereas the cam arm functions as a slave means for producing at the same time a secondary design that differs from the primary design and which secondary design is spaced from the primary design.

BRIEF DESCRIPTION OF THE DRAWINGS

FIG. 1 is a top plan view of a tray containing various members for producing various line designs;

DESCRIPTION OF THE PREFERRED EMBODIMENT

Figure 2:
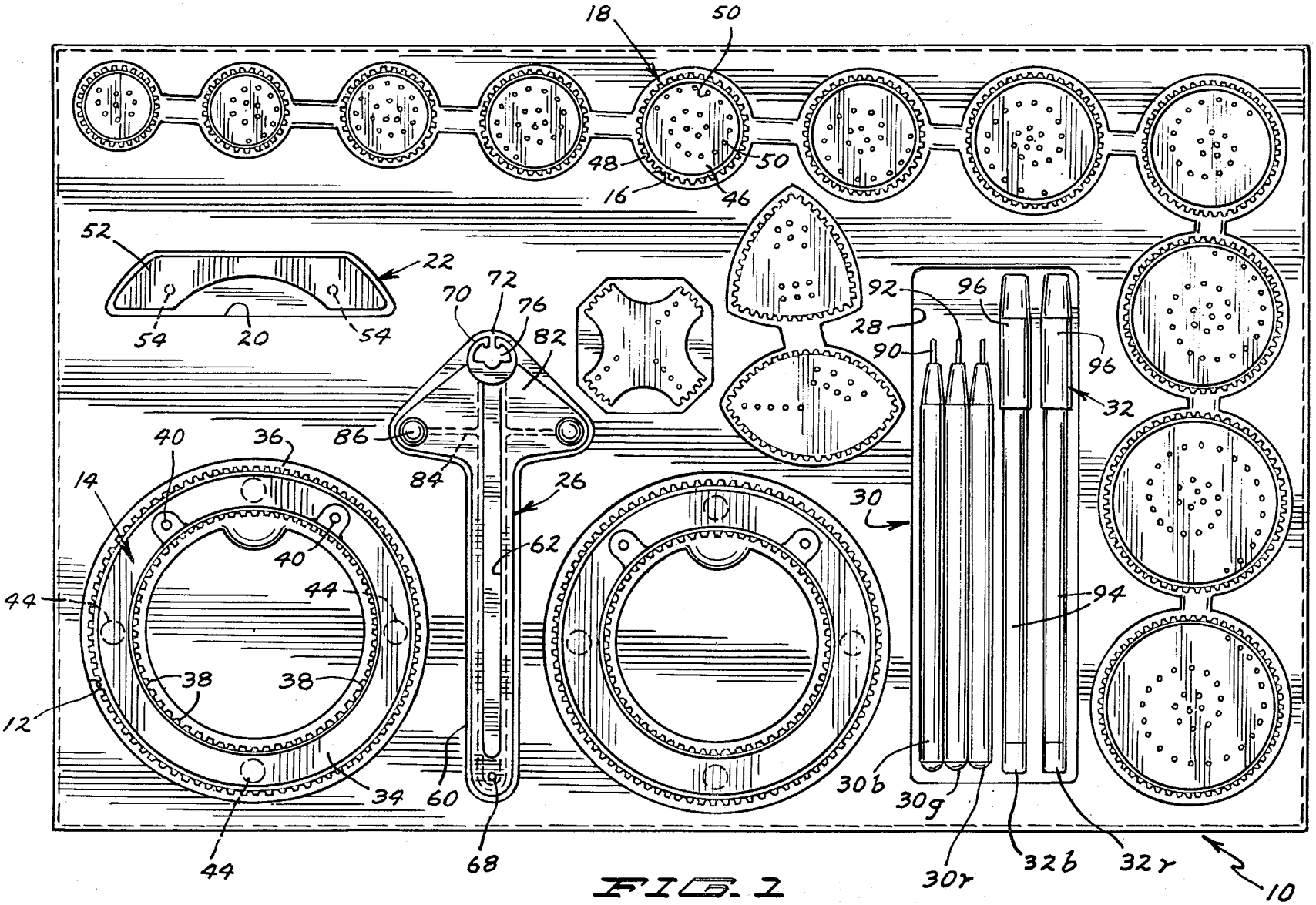
FIG. 2 is a top plan view looking down on a manipulator exemplifying our invention, the manipulator being comprised of some of the parts appearing in FIG. 1 and which parts are in an initial or starting position.
Figure 2:
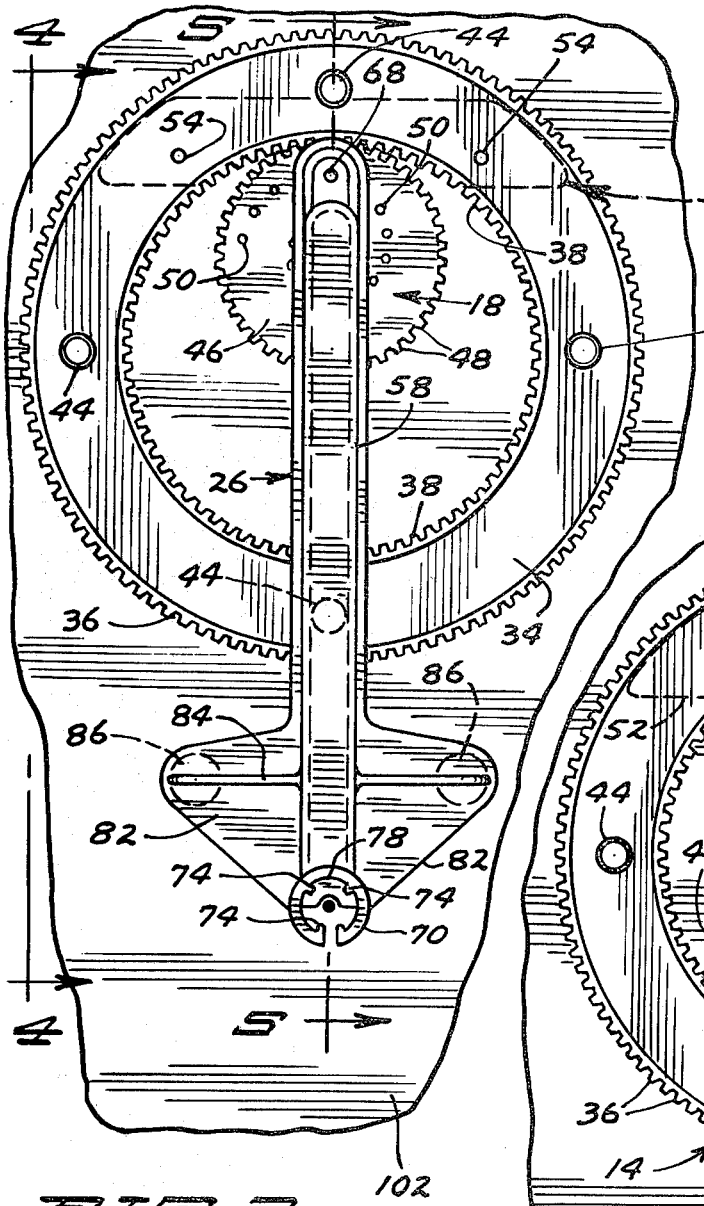

Referring first to FIG. 1, a plastic tray 10 has been illustrated, the tray 10 being of molded plastic, such as polystyrene. Although a relatively large number of cavities or recesses and parts or members placed therein have been pictured in FIG. 1, only several cavities and the parts contained therein will be specifically referred to. The showing of a relatively large number of parts, as the description progresses, will demonstrate the versatility that is possible when following the teachings of our invention.

Considering several of the cavities or recesses and parts molded into the tray 10, it will be observed that there is a cavity or recess 12 in which is placed a ring member 14 which will be described more fully hereinafter. Similarly, there is a circular cavity 16 in which has been placed a wheel member 18. A cavity 20 contains a holder 22, whereas a specially configured cavity 24 has placed therein a cam arm 26. Still another cavity or recess 28, this cavity being rectangular, contains three ballpoint pens 30; more specifically, the pen labeled **30*b* contains red ink; the pen 30*g* green ink and the pen 30*r* red ink. In addition to the three ballpoint pens 30, the recess 28 is of a size so as to contain two fiber-tipped pens 32, the blue fiber-tipped pen being indicated by the reference numeral 32*b* and the red fiber-tipped pen by the reference numeral 32*r***. It will be appreciated that the colors just mentioned are only representative; any number of different color pens can be used in order to impart various hues to the design that will be more specifically described hereinafter.

Whereas two annular rings appear in the tray 10 of FIG. 1, the one denoted generally by the reference number 14 includes an annular body or strip 34 having a number of outside gear teeth 36 and a number of inside gear teeth 38. The body or strip 34 has two anchor holes 40 formed therein, there being a U-shaped reinforcing rib 42 extending in a spaced relationship with each of the holes 40. Additionally, the annular body or strip 34 is formed with four pivot posts 44, the pivot posts extending downwardly in FIG. 1 but upwardly in actual use as best understood from FIGS. 4 and 5. The ring 14 can be molded from a suitable plastic, such as styrene copolymer.

Describing now in greater detail the wheel 18, it will be discerned that the wheel 18 is comprised of a circular disk 46 having peripherally disposed gear teeth 48. As readily understood from the drawings, the disk 46 has a decidedly different radius of curvature as compared to the annular strip 34. The wheel 18 contains a number of holes 50, the holes being spirally oriented as is evident from FIGS. 2 and 3. It is contemplated that the wheel 18 be fabricated from the same type of plastic as the ring 14, namely, styrene copolymer.

Inasmuch as parts corresponding to the ring 14 and the wheel 18 are more fully described in the hereinbefore identified reissue patent, reference can be made thereto, if desired, for supplemental information. It should be recognized, though, that the various additional wheels, both circular and noncircular (but preferably having differently curved edges and varying radii), appearing in FIG. 1 permit a large number of designs to be made. In this regard, the second and unnumbered ring to the right of the ring 14 has a different number of outer teeth and a different number of inner teeth from the ring 14, thereby enabling still a greater number of design variations to be produced. It is contemplated that the wheel 18 be fabricated from the same type of plastic as the ring 14.

With respect to the holder 22, though, it is preferred that the holder 22 be of polyethylene. The holder 22 includes a relatively thin base 22 having pointed pegs 54 projecting from one side thereof. In FIG. 1, the pegs 54 extend downwardly, but in actual use the pegs 54 extend upwardly. It will presently become clear that the holder 22, while performing an important function, is not actually part of the combination of parts of members comprising our invention.

Playing an important role in the practicing of our invention is the cam arm 26, the details of which will now be described. In this instance, it is intended that it be of polystyrene, thereby corresponding to the material used for the ring 14 and wheel 18. However, it will be appreciated that other plastics are suitable, ABS being a suitable substitute but somewhat less desirable in that such material is not as transparent, a property that can be realized when polystyrene is employed.

Figure 7:
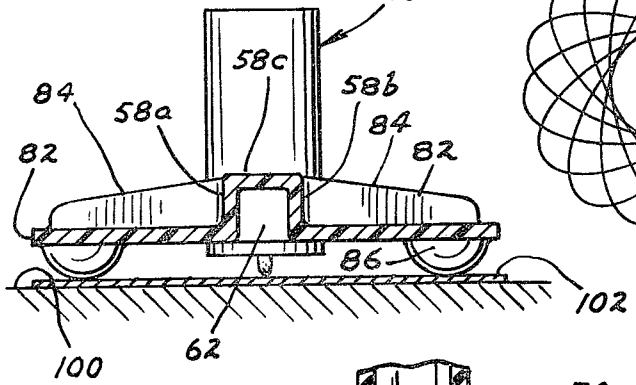
FIG. 7 is a sectional detail taken in the direction of line 7—7 of FIG. 6.
Figure 8:
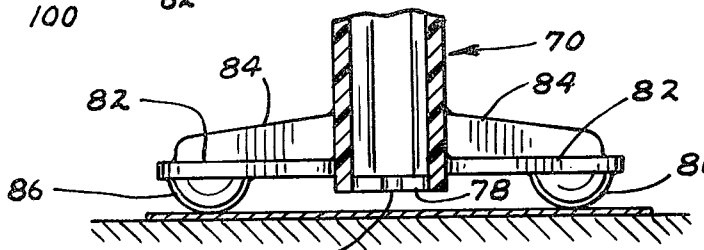
FIG. 8 is a sectional detail taken in the direction of line 8—8 of FIG. 6.

Describing in detail the cam arm 26, it will be observed that the cam arm 26 includes an elongated body 54 having a channel-shaped cross section comprised of parallel side walls **58*a* and 58*b*, and a top wall 58*c*, the walls 58*a*, 58*b* and 58*c* forming a U-shaped configuration as can readily be perceived from FIG. 7. Integral with the lower edge of the side walls 58*a* and 58*b* is a horizontal flange 60, the horizontal flanges 60 forming a downwardly facing slot 62** therebetween.

The cam arm 26 further includes a tab or ear 63 at one end, the tab or ear 63 having an upstanding U-configured rib 63. Outwardly adjacent the U-shaped rib 64 is a horizontal U-shaped flange 66, the flange 66 constituting an integral extension of the previously mentioned horizontal flanges 60. The tab or ear 63 has a hole 68 formed therein for a purpose presently to be explained.

At the other end of the arm 26 is a tube or sleeve 70, the tube or sleeve 70 being resilient and radially expansible by virtue of a vertical slit 72. Four angularly disposed ribs 74 are molded within the tube or sleeve 70 for a purpose soon to be made clear. The tube or sleeve 70 has an opening or hole 76 at its lower end formed by a semiannular web 78 that extends substantially half way across the bottom end, the web 78 having a semicircular notch 80 therein. In other words, the hole 76 constitutes approximately one-half of the bore of the sleeve 70 at the lower end thereof, the remaining bore area being occupied or closed by the web 78.

Continuing with the description of the cam arm 26 it is to be noted that a pair of laterally extending wings 82 are provided, being near the sleeve 70, therebeing reinforcing ribs 84 on the upper surfaces of the wings 82. Beneath the wings 82, and integral therewith, are semispherical or ball-shaped feet 86, there being one such foot 86 under each wing 82. The depending rounded feet 86 perform a stabilizing function.

Although the ballpoint pens 30 are conventional and readily purchasable, it will be mentioned that each includes a casing 88, an ink delivery tube 90 having a ball 92 at its free end. As with the pens 30, the pens 32 each include a casing 94 but have a relatively soft fiber tip 96 that applies ink in the form of a line generally similar to the line formed by the ball 92 of the pen 30. To prevent undue evaporation of the ink from the fiber tip 96 a closure cap 98 is frictionally attached to the lower end of the casing 94.

Figure 10:
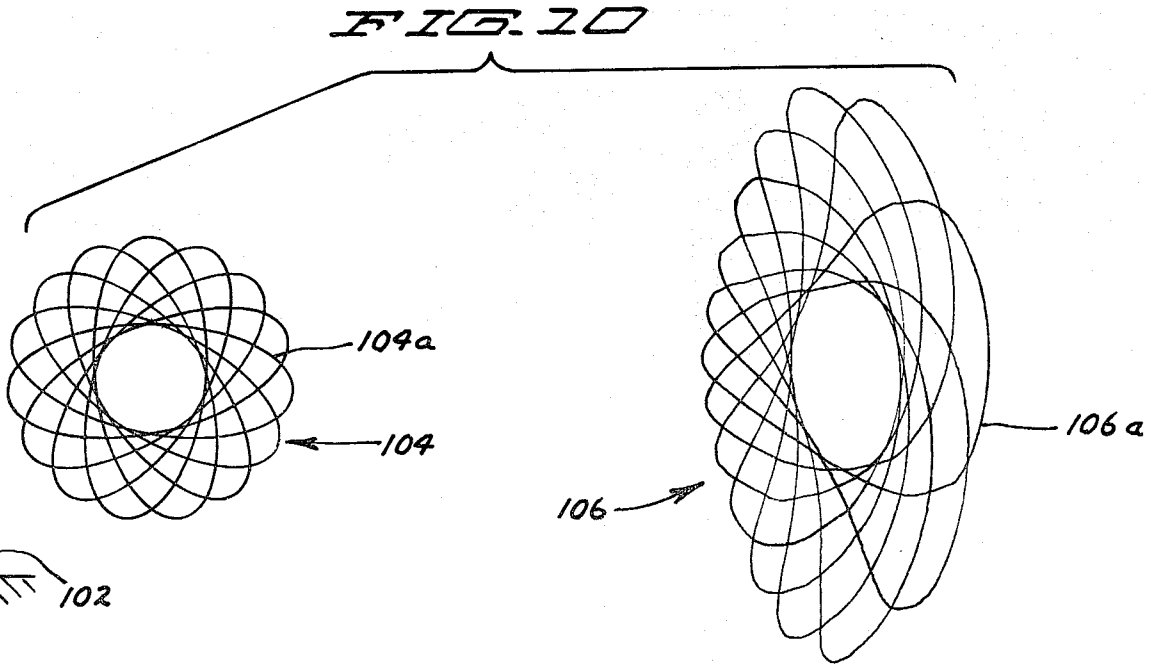
Figure 9:
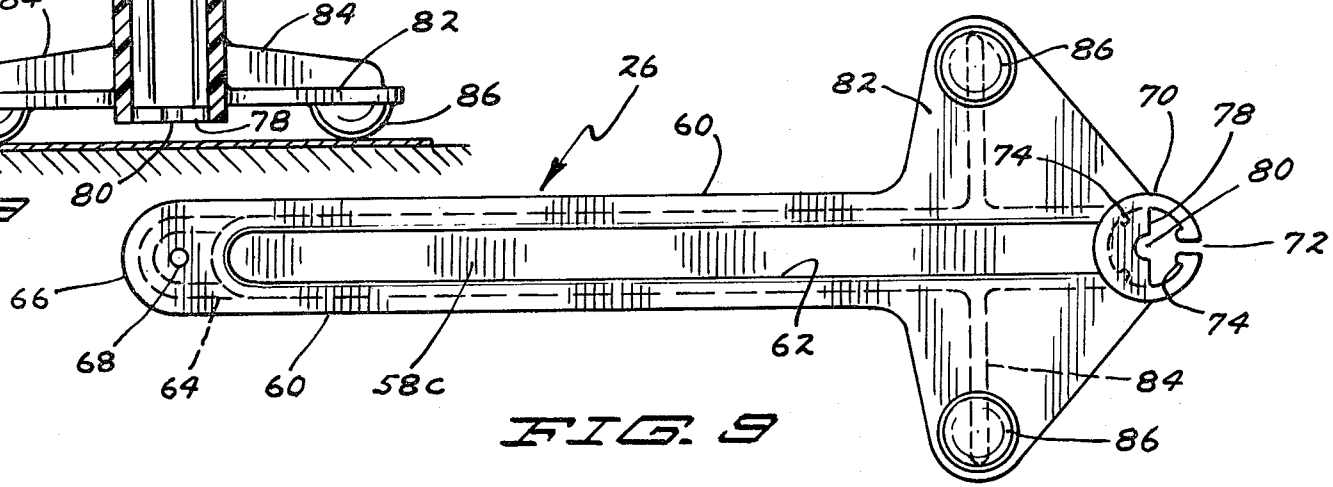
FIG. 9 is a bottom plan view of the cam arm, the view being on the same scale as in FIG. 6, and FIG. 10 portrays two completed line designs on a smaller scale than the beginning of such lines as depicted in FIG. 3, the designs being kept simple mainly for reasons of drawing clarity.

While not actually a part of our invention, although necessary, a table top or other firm horizontal surface 100 supports a sheet of paper 102 thereon, the paper 102 permitting a primary line design 104 and a secondary line design 106 to be produced, these designs 104, 106 appearing in FIG. 10.

Although the manner of using the manipulator comprised of the parts 14, 18 and 26, in combination with the marking implements 30 and 32, should be readily understood from the drawings and the description thereof that has been given, it will help, it is believed, to explain that the ring 14 and the wheel 18, together with the particular ballpoint pen 30 that is selected, constitute master apparatus or master means for producing the primary design 104, whereas the cam arm 26, together with a selected fiber-tipped pen 32, constitutes a slave apparatus or slave means for producing the secondary design 106 appearing in FIG. 10. It should also be understood that the ring 14 (without any pivot post 44, however) and the wheel 18 find general correspondence in the apparatus previously described in the reissue patent mentioned herein as the closest prior art. It is the capability of our manipulator comprised of the parts 14, 18 and 26, together with the implements 30 and 32, to produce simultaneously both the primary design 104 and the secondary design 106.

Inasmuch as the ring 14 should be prevented from shifting on the paper 102, the holder 22 serves as an effective aid in this reagrd. The user merely places the base 52 of the holder 22 with the pointed pegs 54 uppermost. He or she then positions the paper 102 over the holder 22, pressing down on the paper 102 to cause the pegs 54 to pierce or impale the paper. Having done this the user then places the ring 14 on n positions the paper 102 over the holder 22, pressing down on the paper 102 to cause the pegs 54 to pierce or impale the paper. Having done this the user then places the ring 14 on the paper 102, making sure the pegs 54 extend upwardly through the two anchor holes 40 provided in the ring for this purpose.

The user then aligns the hole 68 of the cam arm 26 with a selected hole 50 in the wheel 18. In practice, the various holes 50 will have numbers associated therewith so that the user can progress from one hole 50 to the next in creating a complex line design, such as the primary design 104 of FIG. 10. The design 104 is not aesthetically representative of what can be created in that the variegated color patterns that can be realized in practice by substituting one pen 30 for another and one pen 32 for another cannot be illustrated.

It is the ink delivery tube 90 of whatever ballpoint pen 30 is selected that physically interconnects the wheel 18 with the ring 14, doing so through the registerable holes 50 and 68. While the first hole 50 of the spiral hole pattern in the wheel 18 has not been used, the fifth hole in the spiral pattern having been somewhat arbitrarily selected in order to illustrate our invention, it will be recognized that when the ballpoint pen 30 is moved from the nine o'clock position of FIG. 2 to the three o'clock position of FIG. 3, then the line **104*a* is formed which is the initial segment of the overall design 104 of FIG. 10. The line 104*a* appears in both FIGS. 3 and 10, but on a smaller scale in FIG. 10 than in FIG. 3**.

It should be understood that the line **104*a* is formed irrespective of whether the cam arm 26 is utilized. In other words, if the cam arm 26 is not utilized and the ballpoint pen 30 is simply inserted in the hole 50 of the wheel 18 without the cam arm 26 being present, the line 104*a* would be produced. Furthermore, the entire design 104 could be created without the cam arm 26 being employed in the combination of parts shown in FIGS. 2 and 3. It should be appreciated that the ballpoint pen 30 is manually moved by the user. As already indicated, the ring 14 and the wheel 18 constitute a master means for producing the primary design 104**.

Our invention, of course, is concerned with producing two distinctively different line designs, both the primary design 104 and the secondary design 106, creating both at the same time. When the hole 68 is positioned in registry above a selected hole 50 in the wheel 18, care must be exercised to assure that one of the upstanding pivot posts 44 extends upwardly through the slot 62 into the channel-shaped body 58, the post 44 serving as a fulcrum point about which the cam arm 26 pivots or oscillates while being moved longitudinally or lengthwise. In this way, the movement of the ballpoint pen 30 when inserted into the registered holes 68 and 50 will be guided by the rolling action derived from the peripherally disposed teeth 48 on the wheel 18 which are in mesh, and should be maintained in mesh, with the inside teeth 38 on the ring 14.

Figure 3:
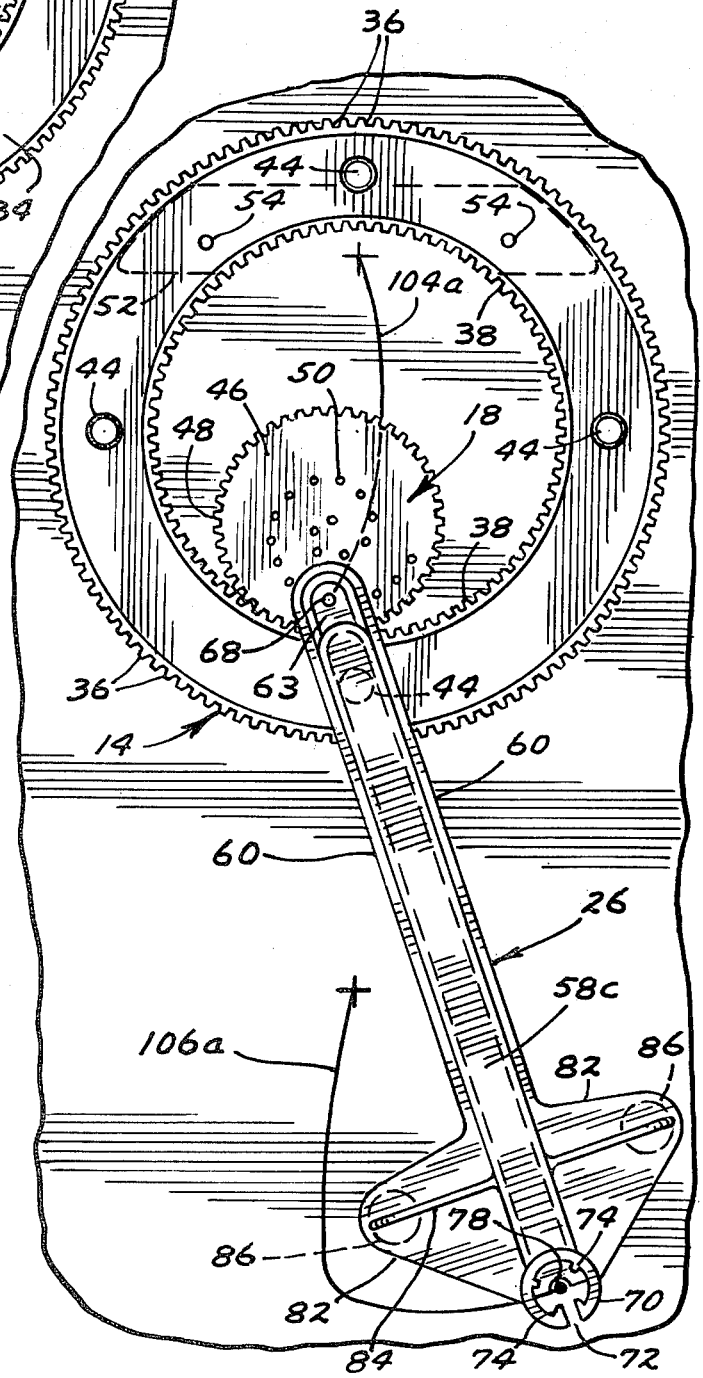
FIG. 3 is a view similar to FIG. 2 but illustrating the manipulator in the process of creating two different and physically separated line designs, even though the two marking implements used to form the designs have been omitted in this view, as well as in FIG. 1, in order to highlight the details of the parts constituting the manipulator.
Figures 4, 5, 6:
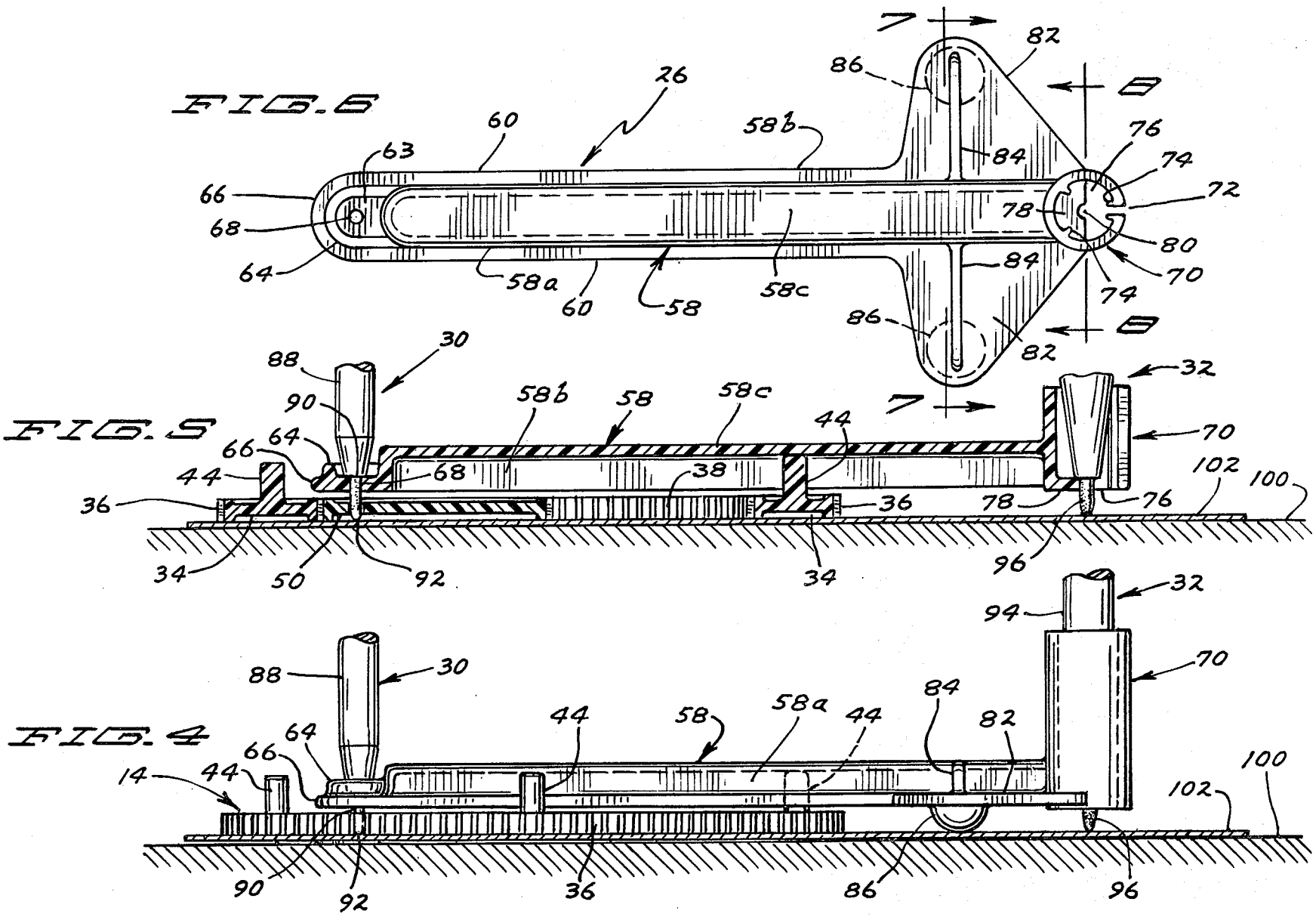
FIG. 4 is an enlarged side elevational view taken in the direction of line 4—4 of FIG. 2, the view additionally showing the lower end portions of both marking implements, the one at the left being a ballpoint pen and the one at the right being a fiber-tipped pen.
FIG. 5 is a sectional view taken in the direction of line 5—5, the view being on the same scale as FIG. 4 and depicting the portions of the marking implements appearing in FIG. 4.
FIG. 6 is a top plan view of the cam arm without either of the implements of FIGS. 4 and 5 included, the cam arm thus appearing as it does in FIGS. 2 and 3 but on a larger scale.

Even though neither a ballpoint pen 30 nor a fiber-tipped pen 32 has been illustrated in FIGS. 2 and 3, nonetheless from FIGS. 4 and 5, both of which figures include a ballpoint pen 30 at the left and a fiber-tipped pen 32 at the right, are illustrated. From FIGS. 4 and 7, it will be appreciated that the fiber-tipped pen 32 is releasably held in the split tube or sleeve 70 by virtue of the angularly disposed ribs 74, the web 78 positioning the pen 32 vertically within the sleeve 70 so that the fiber-tip 96, as can be seen in FIGS. 4, 5 and 7 projects downwardly through the bottom opening 76 just the right amount so as to contact the paper 102. Cooperating in the maintenance of the fiber-tip 96 in the proper relation so as to have it bear correctly against the paper 102 are the ball-shaped feet 86. Thus, the ball-shaped feet 86 are instrumental in gliding over the paper 102, maintaining the desired degree of pressural contact (due to gravity) between the fiber tip 96 and the paper 102, all as believed readily apparent in FIGS. 4, 5 and 7. Stated somewhat differently, the ball-shaped feet 86 perform a stabilizing function, together with the lateral wings 82, to maintain the cam arm 26 horizontal and also parallel to the ring 14 and the wheel 18 during the dual design making procedure.

Consequently, even though neither marking element 30 nor 32 is shown in FIGS. 2 and 3, it will be recognized that concomitantly with the forming of the line **104*a*, the line 106*a* is formed. Thus, the ballpoint pen 30 produces the line 104*a*, whereas the fiber-tipped pen 32 slavingly draws the line 106*a*. It should be appreciated that the cam arm 26, as the term denotes, is indeed a "slave" to the "master", the master means including the ring 14 and wheel 18**.

Whereas the ballpoint pen 30 is manually held by the user and automatically guided by the wheel 18, it will be appreciated that any one of the ballpoint pens **30*b*, 30*g* or 30*r* can be used (as well as still additionally colored ballpoint pens) and that at any stage the user can change from one ballpoint pen 30 to another without difficulty, for all that the user need do is to lift the pen 30, that is, retract or withdraw the tube 90 and the particular ball 92 belonging to such pen 30 from the holes 38 and 50, inserting in its stead a different ballpoint pen 30 having a different color ink contained therein. The pen substitution can be made utilizing the same hole 50 in conjunction with the hole 68 in creating the design 104 or the pen substitution can be made when progressing from one hole 50 to the next hole 50, or to any other hole 50 in the wheel 18 if the user chooses to skip holes. In other words, a programmed selection of the holes 50** and the registering of a particular hole 50 with the hole 68 in the cam arm 26 is in no way necessary.

What transpires, though, is that whatever pattern is produced by reason of the selected ballpoint pen 30 and the holes 68, 50, there will be a controlled or slaved movement of the cam arm 26 so as to produce a secondary design 106, the particular design 106 only being illustrative of a multiplicity of secondary designs 106 that can be automatically created by virtue of the creation of a particular primary design 104. Of course, a great number of primary designs 104 can be readily produced simply by selecting different wheels 18, such as any one of those appearing in FIG. 1, whether circular, triangular or oval. What is important is that two aesthetically pleasing designs are concurrently created in a physically spaced relation with respect to each other.

Although a particular secondary design 106 will result from a particular primary design 104, the great number of designs lends considerable variety to the use of our manipulator, the user retaining the ability to modify the designs still further as to individual colors. Consequently, whereas a secondary design 106 is derivable from a given design 104, the color variations are always left up to the user. Consequently, the designs 104 and 106 are subject to considerable variation, both as to pattern and color.

We claim:

1. A manipulator for creating primary and secondary line designs comprising master means including first and second members for guiding a first marking implement to form said primary design, said first member being provided with an inner edge having a relatively large radius of curvature and said second member being provided with an outer edge having a relatively small radius of curvature and said second member having a plurality of holes at different distances from its said outer edge, said inner and outer edges being engageable with each other, and slave means controlled by said master means for guiding a second marking implement to form said secondary design, said slave means including an elongated cam arm having a hole near one end thereof registrable with a selected one of the plurality of holes in said second member so that one end of said first marking implement can be received in the hole of said cam arm and in the selected hole of said second member to interconnect said cam arm with said second member so that said cam arm is controlled through the agency of said one end of said first marking implement.

2. A manipulator in accordance with claim 1 in which the other end of said cam arm has a second hole for receiving one end of said second marking implement.

3. A manipulator for creating primary and secondary line designs comprising a master means for guiding a first marking implement to form said primary design, and slave means controlled by said master means for guiding a second marking implement to form said secondary design, said master and slave means each having registrable holes for receiving one end of said first marking implement, said one end of said first marking implement interconnecting said master and slave means so that said slave means is controlled by said master means through the agency of said one end of said first marking implement, said slave means having a second hole for receiving one end of said second marking implement, said slave means including a pivotal cam arm, the first hole in said slave means being near one end of said arm and the second hole of said slave means being near the other end of said cam arm, and a post on said master means for effecting pivotal movement of said cam arm.

4. A manipulator in accordance with claim 3 in which said cam arm has a slot, said post extending into said slot to enable both oscillatory and longitudinal movement of said cam arm to occur relative to said master means.

5. A manipulator in accordance with claim 4 including means circumjacent said second hole for resiliently gripping said second marking implement.

6. A manipulator in accordance with claim 5 including stabilizing means on said cam arm for contacting the surface on which said designs are formed.

7. A manipulator in accordance with claim 6 in which said stabilizing means includes a wing extending laterally from each side of said arm, said wings being near said second hole, and each of said wings having an integral foot depending downwardly therefrom for slidably contacting the surface on which said designs are formed.

8. A manipulator in accordance with claim 7 in which said first marking implement constitutes a ballpoint pen and said second marking implement constitutes a fiber-tipped pen.

9. A manipulator for creating primary and secondary line designs comprising master means for guiding a first marking implement to form said primary design, and slave means controlled by said master means for guiding a second marking implement to form said secondary design, said master means including a pair of members having curved edges, said curved edges each being provided with gear teeth and the gear teeth of said members being in mesh when producing said primary and secondary designs.

10. A manipulator in accordance with claim 9 in which one of said members is relatively large with its teeth being internal and the other of said members is provided with external teeth.

11. A manipulator in accordance with claim 10 in which said slave means includes a cam arm, said other member and said arm having registerable holes for the accommodation therein of the marking end of said first implement, and means on said cam arm for holding said second marking implement.

12. A manipulator in accordance with claim 11 in which said holding means includes a split sleeve, the marking end of said second implement projecting through the lower end of said sleeve.

13. A manipulator in accordance with claim 12 including a plurality of longitudinal ribs in said sleeve for releasably engaging said second implement.

14. A manipulator in accordance with claim 13 including laterally located feet on said cam arm for stabilizing said cam arm.

15. A manipulator in accordance with claim 14 in which said cam arm has a channel-shaped body providing a downwardly facing slot, and said one member has an upstanding post projecting upwardly through said slot into said channel-shaped body.

* * * * *